US006567740B2

(12) United States Patent
Eichenseher et al.

(10) Patent No.: US 6,567,740 B2
(45) Date of Patent: May 20, 2003

(54) CIRCUIT FOR LOAD CONTROL AND METHOD FOR THE EMERGENCY OPERATION OF AN INTERNAL COMBUSTION ENGINE

(75) Inventors: Volker Eichenseher, Beratzhausen (DE); Andreas Hartke, München (DE); Thomas Vogt, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/033,235

(22) Filed: Oct. 22, 2001

(65) Prior Publication Data

US 2002/0072837 A1 Jun. 13, 2002

Related U.S. Application Data

(63) Continuation of application No. PCT/DE00/01117, filed on Apr. 11, 2000.

(30) Foreign Application Priority Data

Apr. 21, 1999 (DE) ..... 199 18 032

(51) Int. Cl.[7] ..... F02D 41/22
(52) U.S. Cl. ..... 701/114; 123/348
(58) Field of Search ..... 701/114; 123/345–348, 123/90.11

(56) References Cited

U.S. PATENT DOCUMENTS 5,022,357 A * 6/1991 Kawamura ..... 123/90.11
5,765,031 A 6/1998 Mimuth et al. ..... 714/43

FOREIGN PATENT DOCUMENTS

| | | | | |
|---|---|---|---|---|
| DE | 19518056 | A1 | 11/1996 | |
| DE | 19526683 | A1 | 1/1997 | |
| DE | 19610468 | A1 | 2/1997 | |
| DE | 29712502 | U1 | 10/1997 | |
| DE | 19756342 | A1 | 7/1999 | |
| EP | 0376714 | A2 | 7/1990 | |
| EP | 0724067 | A1 | 7/1996 | |
| JP | 10-47142 | * | 2/1998 | ..... F02D/41/22 |

OTHER PUBLICATIONS

Japanese Patent Abstract No. 11294252 (Kuratsugu), dated Oct. 26, 1999.

* cited by examiner

*Primary Examiner*—Andrew M. Dolinar
(74) *Attorney, Agent, or Firm*—Laurence A. Greenberg; Werner H. Stemer; Ralph E. Locher

(57) ABSTRACT

In the event of a failure or a disruption of an exchange of data between a valve control unit and an operational control unit of an internal combustion engine with electromechanically activated inlet valves, a valve control unit switches over the electromagnetic activation of the inlet valves to full-load control times. The operational control unit suitably sets a throttle valve in order to cause the load control of the internal combustion engine no longer to be performed by the valve load control but rather by the throttle-valve load control in the emergency operating mode.

14 Claims, 2 Drawing Sheets

CIRCUIT FOR LOAD CONTROL AND METHOD FOR THE EMERGENCY OPERATION OF AN INTERNAL COMBUSTION ENGINE

CROSS-REFERENCE TO RELATED APPLICATION

This application is a continuation of copending International Application No. PCT/DE00/01117, filed Apr. 11, 2000, which designated the United States.

BACKGROUND OF THE INVENTION

Field of the Invention

The invention relates to a circuit for load control of an internal combustion engine that takes in a mixture and has at least one electromechanically activated inlet valve. The invention also relates to a method for an emergency operation of the internal combustion engine. The load control of the internal combustion engine is performed exclusively by driving an activation device of the inlet valve.

Internal combustion engines whose charge cycle valves, in particular whose inlet valves, are activated electromechanically are known. In contrast to camshaft-activated valves, these valves are actuated so as to open and close as a function of the rotary position of the crankshaft; there is no fixed mechanical coupling to the crankshaft.

Electromechanical final controlling elements for charge cycle valves are known, for example, from German Patent DE 297 12 502 U1. The valves have a position of rest, which is located between a closed position and an open position and from which they can be deflected by electromagnets.

In order to open or close the valve, the winding of the respective electromagnet is energized, the necessary current being greater in a capture phase than in a holding phase in which the valve is held in an end position. Such an electromechanical method of activating a charge cycle valve has the advantage that in the case of a spark ignition internal combustion engine which intakes a mixture, the load control can be performed directly by driving the activating device for the inlet valves, at least in a wide load range. For example, for low loads it may be necessary to additionally activate a throttle valve.

It is thus known, for example from Published, Non-Prosecuted German Patent Application DE 196 10 468 A1, to implement the load control in the case of an internal combustion rail with gas valves which can be actuated freely. The load control is implemented by setting different opening and closing times of the charge cycle valves, and to assign a throttle valve which can be actuated appropriately to the charge cycle valves at high speeds and at simultaneously low engine torques.

Given a normal camshaft activation, the inlet valves are always opened and closed with full load times and a throttle valve is suitably set for load control in the intake tract.

As a result of the resolution of the fixed mechanical coupling between the valves and the crankshaft, which is obtained with the electromechanical activation, the control times of such valves can be freely selected so that the throttle valve no longer has to be activated, as a result of which throttle losses of the order of magnitude of 10 to 20% are eliminated.

Published, European Patent Application EP 0376714 A2 discloses a monitoring system which, when a fault is detected in electromagnetic pores which each activate an inlet valve, generates a fault signal in order to deactivate the respective inlet valves.

The actuation of the electromechanically activated valves as a function of the rotary position of the crankshaft and in accordance with predefined values of an operational control unit is generally carried out by a separate valve control unit which suitably sets or adjusts the energization of the electromagnets of the electromechanical final controlling elements. For this purpose, the valve control unit receives a signal relating to the crankshaft setting as well as suitable predefined values from the operational control unit of the internal combustion engine. For this reason, it is connected to the operational control unit via a communications line, generally via a CAN-BUS.

Although the communications lines have proven to be relatively operationally reliable, faults or failures of these connections are nevertheless possible. For example, a CAN-BUS can fail if a subscriber on the BUS does not understand a message and outputs a respective fault message and the latter then leads to avalanche-like fault messages from other BUS subscribers.

If the communications connection between the operational control unit and the valve control unit then fails, possibly even only for a brief time, the load of the internal combustion engine can no longer be controlled by the operational control unit.

SUMMARY OF THE INVENTION

It is accordingly an object of the invention to provide a circuit for load control and a method for an emergency operation of an internal combustion engine which overcomes the above-mentioned disadvantages of the prior art methods and devices of this general type, which takes in a mixture and has at least one electromechanically activated inlet valve and whose load control is brought about in the normal mode only by activating the inlet valves, with the result that load control is still possible in an emergency operating mode when the communications connection between the operational control unit and the valve control unit fails.

With the foregoing and other objects in view there is provided, in accordance with the invention, a method for implementing an emergency operation of an internal combustion engine having at least one electromechanically activated inlet valve. The method includes the steps of carrying out load control predominantly in a normal mode by the at least one electromechanically activated inlet valve being actuated by a valve control unit in accordance with values predefined by an operating control unit of the internal combustion engine. The operational control unit controls the throttle valve for changing a load. The valve control unit switches over an electromechanical activation of the at least one electromechanically activated inlet valve to permanently predefined control times if the operational control unit detects that the load control normally performed by actuating the at least one electromechanically activated inlet valve is not operating normally.

According to the inventive concept, the valve control unit of the internal combustion engine switches over the electromechanical activation of the inlet valves to permanently predefined control times (for example full-load times). The operational control unit moves a throttle valve, which is opened in the normal mode, into a suitable load setting if the communication or the exchange of data between the operational control unit and the valve control unit is disrupted. In the emergency operating mode, the internal combustion engine then behaves as an internal combustion engine with conventional camshaft valve drive.

Because it takes a certain amount of time to set the throttle valve to the necessary load setting, while it is possible to switch the electromechanical activation of the inlet valves over to the permanently predefined control times from one working cycle to the next, the valve control unit advantageously waits a specific time period before performing the switchover in order to ensure that the throttle valve has been moved into the necessary load setting. Either the initiation of the emergency operation can be indicated to the valve control unit by the operational control unit via a separate fault signal line—and of course the valve control unit can also signal a failure of the communications connection to the operational control unit via this fault signal line—or the valve control unit alone, or the valve control unit and operational control unit together, initiate the emergency operation independently.

In one optional embodiment, the valve control unit can also itself directly or indirectly actuate the throttle valve.

In accordance with an added mode of the invention, there is the step of using the operational control unit to start the emergency operation if communication between the operational control unit and the valve control unit is disrupted, by outputting a signal to the valve control unit via a fault line.

In accordance with another mode of the invention, there is the step of using the operational control unit and the valve control unit jointly and independently to start the emergency operation if communication between the operational control unit and the valve control unit is disrupted.

In accordance with a further mode of the invention, there is the step of using the valve control unit to switch over, with a time delay, to the permanently predefined control times in order to ensure that the throttle valve has been moved into a position which is suitable for the load control.

With the foregoing and other objects in view there is provided, in accordance with the invention, a circuit for load control of an internal combustion engine having at least one inlet valve that can be electromechanically activated. The circuit contains a valve control unit that receives and evaluates a crankshaft setting signal. The valve control unit exchanges data with an operational control unit of the internal combustion engine and activates the inlet valve in dependence on the crankshaft setting signal and on the data received from the operational control unit such that the internal combustion engine runs under a load requested by the operational control unit. In an event of a fault in an exchange of the data between the valve control unit and the operational control unit, the valve control unit switches over an activation of the inlet valve to permanently predefined control times and the operational control unit performs the load control by a throttle valve.

In accordance with an added feature of the invention, a bidirectional BUS connection is provided between the operational control unit and the valve control unit for exchanging the data. The valve control unit switches over independently to the permanently predefined control times in an event of a fault on the bidirectional BUS connection.

In accordance with an additional feature of the invention, a fault signal line is connected between the operational control unit and the valve control unit. The valve control unit switches over to the permanently predefined control times if a predetermined signal is present on the fault signal line.

In accordance with another feature of the invention, the valve control unit switches over, with a time delay, to the permanently predefined control times to ensure that the throttle valve has been moved into a setting that is suitable for the load control.

In accordance with a concomitant feature of the invention, the valve control unit has a way of intervening directly or indirectly in a control of the throttle valve, and when an emergency operation is initiated the valve control unit causes the throttle valve to be set to a necessary load setting.

Other features which are considered as characteristic for the invention are set forth in the appended claims.

Although the invention is illustrated and described herein as embodied in a circuit for load control and a method for the emergency operation of the internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
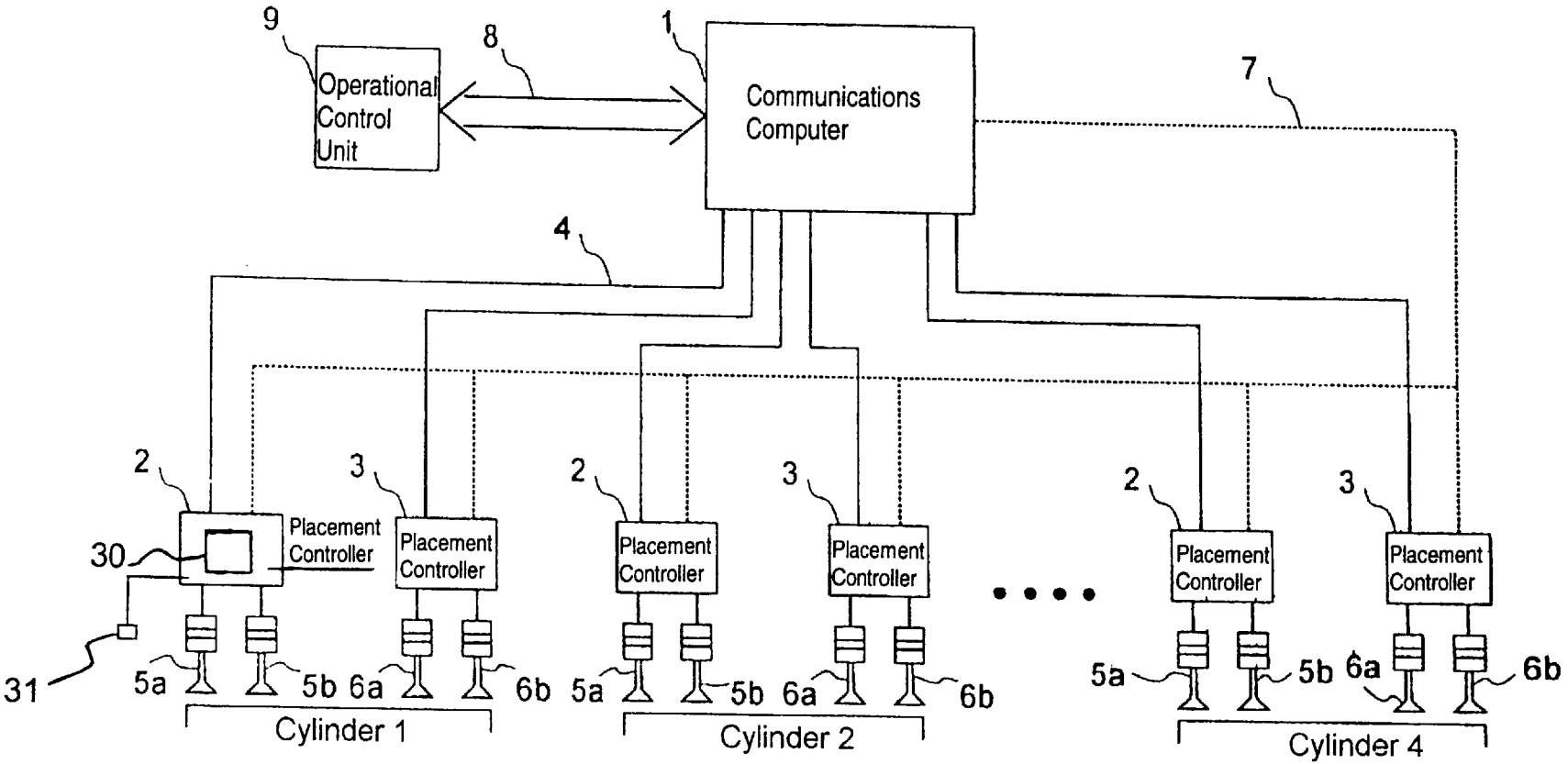
FIG. 1 is a block diagram of a circuit with electromechanically activated charge cycle valves for a 4-cylinder internal combustion engine.

Referring now to the figures of the drawing in detail and first, particularly, to FIG. 1 thereof, there is shown a circuit for actuating electromechanically driven charge cycle valves 5*a*, 5*b*, 6*a*, 6*b*. Such an electromechanically driven charge cycle valve is described, for example, in German Utility Model 297 12 502 U1. The circuit illustrated in FIG. 1 is illustrated for a 4-cylinder internal combustion engine, but the number of cylinders is to be understood only by way of example. In this example, a cylinder has the two inlet valves 5*a*, 5*b*, which are electromechanically activated, as are the two outlet valves 6*a*, 6*b*. A placement controller 2 and 3, respectively, is provided for each of the inlet and outlet valves 5*a*, 5*b* and 6*a*, 6*b* respectively. The placement controller 2, 3 actuate output stages that bring about the energization of respective coils of the valves 5*a*, 5*b*, 6*a*, 6*b*. Here, a separate output stage is provided by way of example for each coil. The placement controllers 2, 3 and the output stages are accommodated in a housing which is connected to a coolant circuit of the internal combustion engine in order to ensure a good conduction away of heat.

The placement controller 2, 3 actuates the output stages as a function of timing signals that indicate when the corresponding valve 5*a*, 5*b*, 6*a*, 6*b* has to open or close. Each timing signal is for example a square-wave signal in which a trailing edge indicates the closing of the valve 5*a*, 5*b*, 6*a*, 6*b* and a rising edge the opening of the valve 5*a*, 5*b*, 6*a*, 6*b*. The timing signals are fed to the placement controllers 2, 3 via unidirectional communications lines 4 from a communications computer 1 which will be described later.

Each of the placement controllers 2, 3 has a digital processor 30 which controls an energization of the coils of the output stages in such a way that the valve 5*a*, 5*b*, 6*a*, 6*b* comes to rest gently in a desired end position. Usually, in order to move the valve 5*a*, 5*b*, 6*a*, 6*b* from one end position into the other, the energization of the coil causing movement to the end position, which is to be departed from is shut down and the energization of the coil of the end position which is to be moved to is switched on. The current is controlled by the processor 30 of the placement controller 2, 3 in such a way that the valve 5*a*, 5*b*, 6*a*, 6*b* comes to rest gently, i.e. in a damped fashion, in the new end position. For this control, the placement controller 2, 3 uses a setting signal which gives information on a position of the valve 5*a*, 5*b*, 6*a*, 6*b*. In order to generate the setting signal, each electromechanical valve 5*a*, 5*b*, 6*a*, 6*b* is provided with a suitable position sensor 31, such as is described, for example, in Published, Non-Prosecuted German Patent Applications DE 197 53 275 or DE 195 18 056 A1. The position sensor 31 can be incorporated into the valve or be separate from the valve as shown in FIG. 1.

The control of a coil current in order to capture the valve 5*a*, 5*b*, 6*a*, 6*b* in the end position is described theoretically in Published, Non-Prosecuted Patent Application DE 195 26 683 A1, for example. For this purpose, the placement controller 2, 3 measures the actual current through the coil and outputs the value of a setpoint current to the output stage. However, instead of the current, it is also possible to use some other variable, which expresses the activation of the final controlling element, for example a driver voltage of the output stage.

In addition to the control of the coil energization, each placement controller, 2, 3 also carries out a plausibility check of the signals i.e. of the setting signal and of the coil energization. It is possible to derive from the latter, as is known from Published, Non-Prosecuted German Patent Application DE 195 26 683 A1, a further signal which permits conclusions to be drawn regarding the position of the valve 5*a*, 5*b*, 6*a*, 6*b* so that the setting signal can be checked by the further signal.

Each of the placement controllers 2, 3 is connected via a further SPI-BUS interface 7 to the communications computer 1 and signals a state of the valve 5*a*, 5*b*, 6*a*, 6*b* and/or a possible valve failure via the interface 7.

The communications computer 1 is connected to a CAN-BUS 8 and carries out the communication with the operational control unit 9 of the internal combustion engine via the CAN-BUS 8. Furthermore, the communications computer 1 receives the crankshaft signal and, together with the requests of the operational control unit 9, calculates from the signal time control signals for the placement controllers 2, 3 and outputs them via the unidirectional communications lines 4 to the placement controllers 2, 3. Via the SPI-BUS 7, the communications computer 1 additionally communicates with the placement controllers 2, 3 and exchanges the status information and/or fault information. Furthermore, the communications computer 1 monitors the entire electromechanical valve drive, i.e. a temperature of the output stages for the valves 5*a*, 5*b*, 6*a*, 6*b*, a supply voltage of the output stages (usually 42 V), a supply voltage of the position sensors 31 (usually 15 V) and a supply voltage of the placement controllers 2, 3 (usually 3.3 V).

Figure 2:
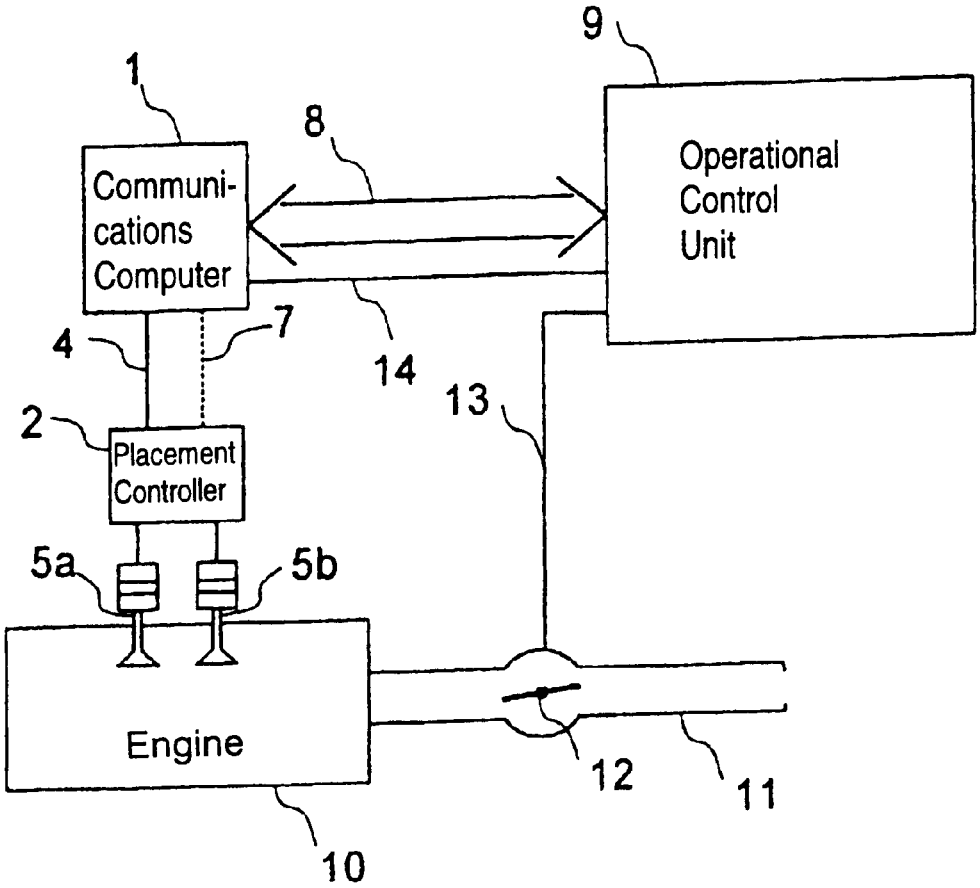
FIG. 2 is a block diagram of the circuit for the internal combustion engine with a throttle valve.

The internal combustion engine with the electromechanically activated valves 5*a*, 5*b*, 6*a*, 6*b* is illustrated in more detail in FIG. 2. The internal combustion engine 10 has the electromechanically activated inlet valves 5*a*, 5*b*, of which just two are illustrated in FIG. 2. The electromechanically activated outlet valves are not shown in FIG. 2. The electromechanically activated inlet valves 5*a*, 5*b* are activated in the previously described manner by the placement controller 2 which is connected to the communications computer 1 in the manner described. The internal combustion engine 10 also has an intake tract 11 in which a throttle valve 12 is located. The throttle valve 12 can be actuated by the operational control unit 9 of the internal combustion engine 10 via a throttle valve control line 13. The operational control unit 9 is, as already described, connected to the communications computer 1 of the valve controller via the CAN-BUS 8. In addition to the connection via the CAN-BUS 8, the operational control unit 9 can also operationally have a fault signal line 14 as a connection to the communications computer 1.

The activation of the inlet valves 5*a*, 5*b* is driven in such a way that the internal combustion engine 10 operates with a certain load. This is brought about by the control times, in particular the opening period of the inlet valves 5*a*, 5*b*. The load is specified to the communications computer 1 by the operational control unit 9 of the internal combustion engine via the CAN-BUS 8.

As a result of the load control, the throttle valve 12 of the internal combustion engine 10, which is located in its intake tract 11 can remain in the open position and does not need to be actuated via the throttle valve control line 13. If the operational control unit 9 detects a fault in the exchange of data via the CAN-BUS 8, it instructs the communications computer 1, via the fault signal line 14, to switch over the valve control times to permanently predefined control times, for example full-load times. In order, nevertheless, to permit the load control of the internal combustion engine 10 to be carried out, the operational control unit 9 simultaneously moves the throttle valve 12 into the suitable load setting via the throttle valve control line 13. The load control of the internal combustion engine 10 is then carried out in the same way as in an internal combustion engine with conventional camshaft activation.

The communications computer 1 advantageously sets, by the placement controllers 2, the electromechanical activation of the inlet valves 5*a*, 5*b* with a certain time offset with 1 respect to a reception of a signal on the fault signal line 14 to the full-load control times, as will now be explained with reference to FIG. 3.

Figure 3:
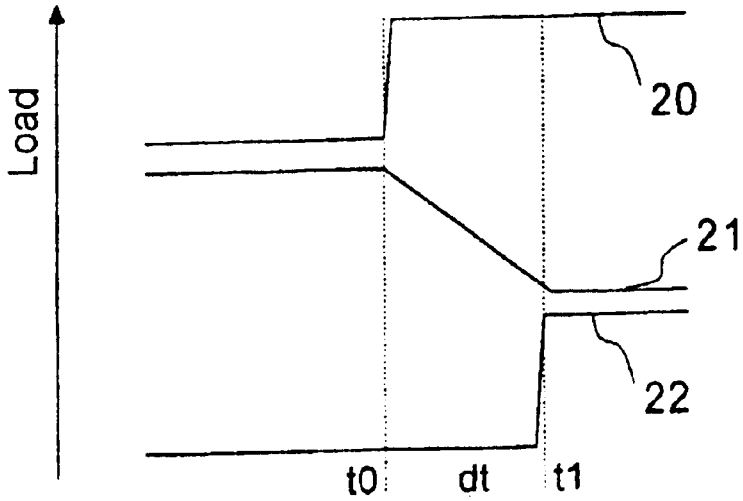
FIG. 3 is a graph of a time profile for a transition from a normal mode to an emergency operating mode.

A load predefined value, which results from the position of the throttle valve 12, is plotted on a curve 21 in FIG. 3. At a time t0, the internal combustion engine 10 detects that the communication via the CAN-BUS 8 is disrupted and starts to move the throttle valve 12 out of the full-load setting into a part load setting, for example 20% load, corresponding to the respective operational phase. Because the throttle valve 12 requires a certain amount of time for such a change of setting of, for example, 80%, it takes a time period dt, approximately 80 ms in our example, until the throttle valve 12 has moved into the respective load setting. The switching over of the inlet valves to full-load control times can, on the other hand, take place from one working cycle to the next.

Therefore, if, as indicated by curve 20, the activation of the inlet valves 5*a*, 5*b* were to be switched over to full-load control times at the time t0, the internal combustion engine 10 would run during the time period dt with a greater load than is desired by the operational control unit 9. In order to avoid this, the communications computer 1 does not bring about the switching over of the electromechanically activated inlet valves 5*a*, 5*b* until a later time t1, as indicated by curve 22.

This ensures that the internal combustion engine 10 does not run with a greater load than desired by the operational control unit 9. The precise selection of the time t1 or of the time offset dt depends of course on a setting speed of the throttle valve 12. Because the throttle valve typically takes 100 ms to move from the load setting 100% to the load setting 0%, the time offset should, however, be of the order of magnitude of 100 ms.

In an alternative embodiment, it is possible to dispense with the fault signal line 14 between the operational control unit 9 and the communications computer 1. The communications computer 1 switches over the electromechanical activation of the inlet valves 5*a*, 5*b* automatically to full-load control times and thus initiates the emergency operation when it has detected a failure or a fault in the exchange of data via the CAN-BUS 8. The operational control unit 9 does the same so that both change independently and automatically from normal operation with load control by activating the inlet valves 5*a*, 5*b* to emergency operation with load control by use of the throttle valve 12.

In an optional embodiment, the communication computer 1 has a possible way of intervening in the setting of the throttle valve 12, for example by a suitable configuration of logic elements in the throttle valve control line 13. If the latter than detects a fault or a failure in the exchange of data via the CAN-BUS 8, either automatically or by an appropriate signal on the fault signal line 14, it brings about the changeover into the emergency operation itself. If a suitable AND element is connected into the throttle valve control line 13, the operational control unit 9 can then assume the control of the throttle valve 12 itself via a suitable line. This embodiment has the advantage that the synchronizing between the shutting down of the valve load control and switching on of the throttle-valve load control is ensured at the transition into the emergency operation.

We claim:

1. A method for implementing an emergency operation of an internal combustion engine having at least one electromechanically activated inlet valve, which comprises the steps of:

carrying out load control predominantly in a normal mode by the at least one electromechanically activated inlet valve being actuated by a valve control unit in accordance with values predefined by an operating control unit of the internal combustion engine;

using the operational control unit to control a throttle valve for changing a load; and using the valve control unit to switch over an electromechanical activation of the at least one electromechanically activated inlet valve to permanently predefined control times if the operational control unit detects that the load control normally performed by actuating the at least one electromechanically activated inlet valve is not operating normally.

2. The method according to claim 1, which comprises using the operational control unit to start the emergency operation if communication between the operational control unit and the valve control unit is disrupted, by outputting a signal to the valve control unit via a fault line.

3. The method according to claim 1, which comprises using the operational control unit and the valve control unit jointly and independently to start the emergency operation if communication between the operational control unit and the valve control unit is disrupted.

4. The method according to claim 1, which comprises using the valve control unit to switch over, with a time delay, to the permanently predefined control times in order to ensure that the throttle valve has been moved into a position which is suitable for the load control.

5. A circuit for load control of an internal combustion engine having at least one inlet valve that can be electromechanically activated, the circuit comprising:

a valve control unit receiving and evaluating a crankshaft setting signal, said valve control unit exchanges data with an operational control unit of the internal combustion engine and activates the inlet valve in dependence on the crankshaft setting signal and on the data received from the operational control unit such that the internal combustion engine runs under a load requested by the operational control unit, and in an event of a fault in an exchange of the data between said valve control unit and the operational control unit, said valve control unit switches over an activation of the inlet valve to permanently predefined control times and the operational control unit performs the load control by a throttle valve.

6. The circuit according to claim 5, including a bidirectional BUS connection between the operational control unit and said valve control unit for exchanging the data, said valve control unit switching over independently to the permanently predefined control times in an event of a fault on said bidirectional BUS connection.

7. The circuit according to claim 5, including a fault signal line connected between the operational control unit and said valve control unit, said valve control unit switching over to the permanently predefined control times if a predetermined signal is present on said fault signal line.

8. The circuit according to claim 5, wherein said valve control unit switches over, with a time delay, to the permanently predefined control times to ensure that the throttle valve has been moved into a setting which is suitable for the load control.

9. The circuit according to claim 5, wherein said valve control unit has a way of intervening directly or indirectly in a control of the throttle valve, and when an emergency operation is initiated said valve control unit causes the throttle valve to be set to a necessary load setting.

10. A circuit for load control of an internal combustion engine having at least one inlet valve that can be electromechanically activated, the circuit comprising:

a throttle valve;

an operational control unit connected to said throttle valve; and a valve control unit connected to said operational control unit and receiving and evaluating a crankshaft setting signal, said valve control unit exchanges data with said operational control unit and activates the inlet valve in dependence on the crankshaft setting signal and on the data received from said operational control unit such that the internal combustion engine runs under a load requested by said operational control unit, and in an event of a fault in an exchange of the data between said valve control unit and said operational control unit, said valve control unit switches over an activation of the inlet valve to permanently predefined control times and said operational control unit performs the load control by said throttle valve.

11. The circuit according to claim 10, including a bidirectional BUS connection between said operational control unit and said valve control unit for exchanging the data, said valve control unit switching over independently to the permanently predefined control times in an event of a fault on said bidirectional BUS connection.

12. The circuit according to claim 10, including a fault signal line connected between said operational control unit and said valve control unit, said valve control unit switching over to the permanently predefined control times if a predetermined signal is present on said fault signal line.

13. The circuit according to claim 10, wherein said valve control unit switches over, with a time delay, to the permanently predefined control times to ensure that said throttle valve has been moved into a setting which is suitable for the load control.

14. The circuit according to claim 10, wherein said valve control unit has a way of intervening directly or indirectly in a control of said throttle valve, and when an emergency operation is initiated said valve control unit causes said throttle valve to be set to a necessary load setting.

* * * * *